US005480118A

United States Patent [19]

Cross

[11] Patent Number: 5,480,118

[45] Date of Patent: Jan. 2, 1996

[54] FOLDABLE EASEL DISPLAY MOUNT

[76] Inventor: Carroll N. Cross, 3202 Holiday Ave., Apopka, Fla. 32703

[21] Appl. No.: 149,115

[22] Filed: Nov. 9, 1993

[51] Int. Cl.[6] ..... A47B 97/04

[52] U.S. Cl. ..... 248/459; 40/120; 248/454; 248/174

[58] Field of Search ..... 248/459, 447, 248/174, 454, 455, 457, 460; 40/120, 152.1; D19/20

[56] References Cited

U.S. PATENT DOCUMENTS

| | | | |
|---|---|---|---|
| 1,219,393 | 3/1917 | Harrison | 248/455 |
| 3,195,850 | 7/1965 | Steiner | 248/459 |
| 3,305,205 | 2/1967 | Frankl | 248/459 |
| 3,305,206 | 2/1967 | Nichols | 248/459 |
| 3,410,516 | 11/1968 | Criswell | 248/459 |
| 4,143,847 | 3/1979 | Cross | 248/459 |
| 4,351,123 | 9/1982 | Cross | 40/120 |
| 4,622,767 | 11/1986 | Sullivan | 40/120 |
| 4,696,118 | 9/1987 | Cross | 40/120 |
| 4,709,895 | 12/1987 | Mardak | 248/459 X |
| 4,817,905 | 4/1989 | Rondone | 40/120 X |
| 4,975,137 | 12/1990 | Cross | 40/120 X |

FOREIGN PATENT DOCUMENTS

| | | | |
|---|---|---|---|
| 725492 | of 1966 | Canada | 248/459 |
| 413581 | 5/1925 | Germany | 40/152.1 |

*Primary Examiner*—Alvin C. Chin-Shue
*Assistant Examiner*—Korie H. Chan
*Attorney, Agent, or Firm*—William M. Hobby, III

[57] ABSTRACT

A foldable easel type display mount apparatus has a display panel having front and rear faces and having a plurality of edges and a rear panel having a plurality of edges. The display panel is hinged to A second display panel for rotation relative to the second display panel. A support panel has a plurality of edges and is hingedly attached to one edge a base panel with a ductile hinge so that the support panel can be moved relative to the base panel for supporting the display panel. The base panel and support panel form a supporting easel for the display panel in different angular positions. The support panel is held in position with the ductile hinge. A rear panel may be attached to the display panel and have the base panel and support panel die cut thereinto. The easel mount eliminates the use of a tongue lock and provides a plurality of display positions.

9 Claims, 1 Drawing Sheet

FOLDABLE EASEL DISPLAY MOUNT

BACKGROUND OF THE INVENTION

The present invention relates to a display mount and especially to a foldable easel type display mount having a supporting panel hinged with a ductile hinge to a rear panel to form an easel for a display panel.

There have been patented and manufactured an increasing number of inexpensive slant-support display easels over the years. Basically these consist of a means for positioning a slanting display or writing surface having easel support means. Usually the structure incorporates one or more vertical panels for displaying advertisements, slogans, logos, calendars or the like.

Unlike wall-mounted displays which can be attached to a solid vertical supporting surface and hence can be readily used as a writing surface, the slant-mount easels must be able to provide adequate support by their inherent structural details when slidably or loosely placed upon a planar support surface, such as a desk or counter top, so as to bear the pressure of writing thereon.

In the past, most of the art pertaining to such structures have been formed of relatively thick, substantially inflexible cardboard stock, with or without plastic facing layers. Such structures generally use a relatively complex tongue and slot means to maintain the easel in operative position and rely on the strength of the materials and their thickness to provide stability during use. Economy makes essential structures which may be shipped in a substantially flat form and thereafter have the easel mount moved into operative position.

Illustrative of such prior art are the following patents: U.S. Pat. No. 2,355,706 to Cross; U.S. Pat. No. 2,750,698 to Nichols; U.S. Pat. No. 3,787,853 to Nichols; U.S. Pat. No. 2,798,322 to Nichols; U.S. Pat. No. 2,825,516 to Cross; U.S. Pat. No. 2,831,285 to Cross; U.S. Pat. No. 2,916,242 to Cross; U.S. Pat. No. 2,926,441 to Cross; U.S. Pat. No. 2,954,625 to Nichols; U.S. Pat. No. 2,958,968 to Nichols; U.S. Pat. No. 2,960,783 to Nichols; U.S. Pat. No. 3,021,631 to Cross; U.S. Pat. No. 3,067,652 to Cross; U.S. Pat. No. 3,068,139 to Cross; U.S. Pat. No. 3,305,206 to Nichols; U.S. Pat. No. 3,580,536 to Nichols; and U.S. Pat. No. 4,143,847 to Cross.

All of the above are easel type mounts and some have structures disclosed therein that have the slanting display support surface positioned at a small acute angle relative to their planar supporting environment because such articles are easier to use on writing and display surfaces. However, this requires an ability of the structure to withstand greater and more frequently applied writing pressure. In theory this problem can be solved by a choice of thick, strong material, such articles are generally used in giveaway promotional calendars, desk memo pads and the like and hence must be inexpensive. The cost of sufficiently thick rigid structures to provide such proper easel mounts has become intolerable from a marketing standpoint especially in view of the increased mailing costs for the heavier items. Therefore, the industry has turned to a search for new structure which can be manufactured with a minimum number of steps and still provide an erectable rigid satisfactory structure using thin, inexpensive and lighter materials.

The present invention accomplishes these desired results by novel means which rely on a ductile hinged support panel easily supporting slant-support mounts by structures which are simpler, less inexpensive and stronger than the structures described and claimed in the above patents.

The Cross et al., U.S. Pat. No. 2,916,242, uses a plurality of multiple, relatively thick cardboard or the like layers hingedly connected panels with a slot and tongue snap-locking means whose cost is greater than that of the present invention. Nichols U.S. Pat. No. 2,954,625 is similarly expensive. This patent is also illustrative of a further difficulty of using such slant-top easel display mounts where a tongue and slot connection is used with thick cardboard or the like. Repeated locking and unlocking causes the material to become dog-eared or frayed and to lose resiliency at the coacting locking means.

In Nichols U.S. Pat. No. 3,305,206, the structures rely upon an abutment layer to tension the easel in operative position and this requires a substantial, expensive thickness for the panels to be maintained in their snap-lock original positions because there will not then be an effective snap-lock operative position attainable with thin layered materials which lack both rigidity and sufficient edge abutment stops. Similar problems are presented by the structures of Nichols U.S. Pat. No. 3,580,536 since the materials which must be used therein require inherent rigidity and resistance to flexure during snap-lock erection and during use in order to be operative. This causes a locking tension which will be variable with continued use as well as relatively thick expensive materials.

Most of these prior art structures require preshaping or prestitching of a memo or calendar pad to the slant support surface since this joining operation cannot be performed after flats are printed and folded for shipment.

It is to be noted that the ability to use the inherent resiliency of paperboard or the like has been long recognized and used, as shown in Larkin U.S. Pat. No. 1,990,739, but this resiliency cannot be maintained uniform during operation because such properties have changed during repeated use by the prior art devices.

The prior Cross U.S. Pat. No. 4,143,847 is an improvement of the prior patents and provides an inexpensive slant support display easel made of thin inexpensive materials to form snap lock slant board easels having greater tension, longer lasting uniform tension, and readily preselectable tension to cause retention of the snap-lock structure. This patent enables the manufacture with a single stapling step which can be performed after the panels are completed, printed, and folded.

A folding easel type display mount normally is formed with a tongue panel which engages a punched out slot when the panel is slid along the rear of a display panel to form the easel. Thus, the use of a ductile hinge eliminates the tongue and the slot. The tongue has a tendency to push against the back of a calendar pad except when very precisely cut and the tongue would sometime slip out of the slot. The present invention provides a display mount which is easel supported with great strength and supports a display panel and calendar display in a wide variety of positions to give the display mount greater flexibility while eliminating the tongue and slots of prior easel type mounts.

The present invention eliminates the tongue altogether in an easel type display mount while providing greater flexibility to the display mount positions.

SUMMARY OF THE INVENTION

A foldable easel type display mount apparatus has a display panel having front and rear faces and having a plurality of edges and a rear panel having a plurality of edges. The display panel is hinged to A second display panel for rotation relative to the second display panel. A support panel has a plurality of edges and is hingedly attached to one edge a base panel with a ductile hinge so that the support panel can be moved relative to the base panel for supporting the display panel. The base panel and support panel form a supporting easel for the display panel in different angular positions. The support panel is held in position with the ductile hinge. A rear panel may be attached to the display panel and have the base panel and support panel die cut thereinto. The easel mount eliminates the use of a tongue lock and provides a plurality of display positions.

BRIEF DESCRIPTION OF THE DRAWING

Other objects, features and advantages of the present invention will be apparent from the written description and the drawings in which.

DESCRIPTION OF THE PREFERRED EMBODIMENT

Figure 1:
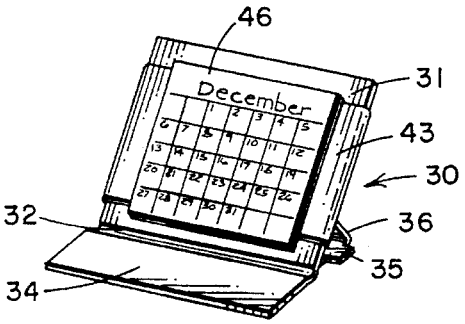
FIG. 1 is a front perspective view of another embodiment of an easel type display mount in accordance with the present invention.
Figure 2:
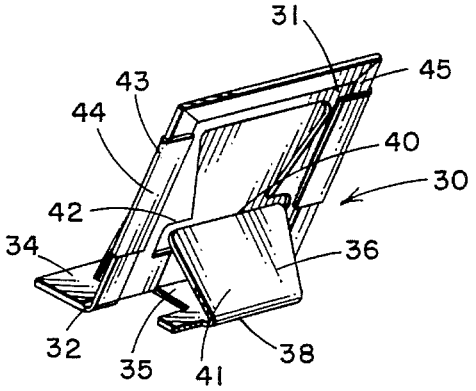
FIG. 2 is a rear perspective view of the embodiment of FIG. 1.
Figure 3:
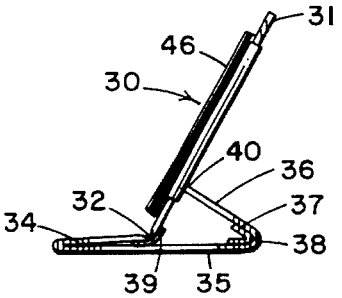
FIG. 3. shows a side elevation of the display mount in accordance with FIGS. 1 and 2.
Figure 4:
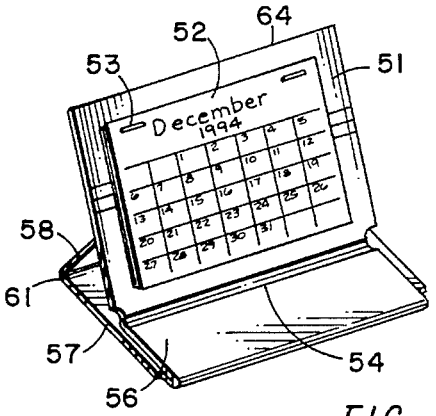
FIG. 4 is a front perspective view of yet another embodiment of an easel type display mount in accordance with the present invention.
Figure 5:
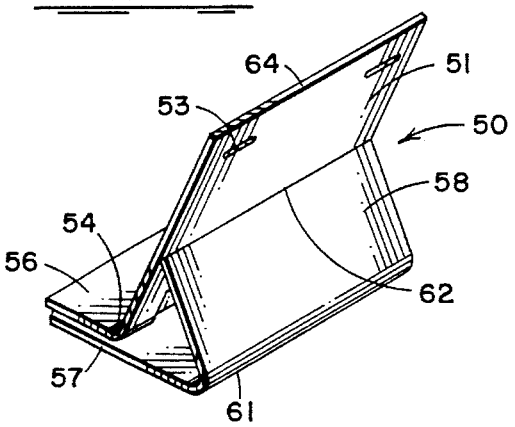
FIG. 5 is a rear perspective view of the display mount of FIG. 4.
Figure 6:
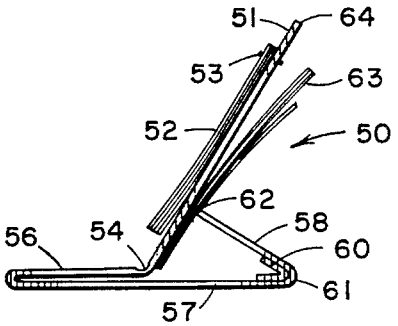
FIG. 6 is a side elevation of the display mount of FIGS. 4 and 5 having insert pages supported therein.
Figure 7:
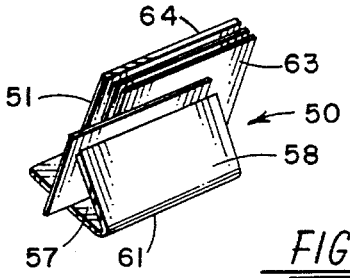
FIG. 7 is a rear perspective view of the display mount of FIG. 6 supporting leaf materials therein.

Referring to the drawings, FIGS. 1 and 2 of the drawings of an easel type display mount 30 is illustrated having a first display panel 31 having a flexible hinge 32 attached to a second display panel 34. A base panel 35 is also attached to the first display panel 31 and is attached to the base panel 35 in a face to face relationship as shown in FIGS. 1 through 3. This allows the panel 31 to be hinged thereto and stiffens the base panel. This allows the display panel 31 to be positioned in an upright position to act as a display sign for a personal desk for someone wishing to convey a special message, i.e. no smoking, or to promote a special product. An easel support panel 36 is used to support the first display panel 31 and has a ductile or aluminum hinge 37 at the hinge line 38 between the panel 35 and support panel 36 so that the panel 36 can be folded to any position desired. Edge portion 40 of panel 36 can support the display panel 31 in different positions. In the embodiment shown in FIGS. 1, 2 and 3, the easel 41 has been cut from a rear panel 31 in the shape, as shown in FIG. 2, to form built-in supporting ledges 42 but since the aluminum hinge 37 has been added, the panel 36 can be positioned in any position desired for adjusting the angle of the display panel 31. A transparent polymer banding 43 has been attached with a heat or electronic seal at 44 to the case binding or laminate covering 45. A calendar pad 46 has been inserted with a portion of the calendar pad positioned behind the transparent binding 43. The easel 41 having the aluminum hinge 37 between the supporting panel 36 and base panel 35 allows for the adjustment of the angle of the display panel 31 and also allows for the insertion of an index card or other sheet material behind the first panel 31, which panel can be pulled forward on the flexible hinge 32, and placed between the rear of the display panel 31 and the edge 40 of the easel supporting panel 36. FIG. 3 is the same as FIGS. 1 and 2 except that the hinge 32 is a ductile aluminum hinge having a strip of aluminum 39 attached to the panels over the hinge line.

Turning to FIGS. 4 through 7, another embodiment 50 of a foldable easel type display mount is illustrated having a display panel 51 having a calendar pad 52 stapled thereto with staples 53. The display panel 51 is flexibly hinged with the hinge 54 to a second display panel 56 attached to a base panel 57. The display panel, supporting panel 58 has an aluminum or ductile hinge 60 hinged along the hinge line 61 to the base panel 57 to allow the supporting panel 58 having elongated edge 62 to be positioned in any position desired by flexing the supporting panel 58 on the ductile hinge 60 to thereby vary the angle of the display panel 51 resting along the edge 62. Advantageously, this allows leaf pages 63, such as telephone or address indexes, to be inserted between supporting panel 58, edge 62 and display panel 51. The display panel 51 can be pulled forward and the leaf material 63 inserted therein. If the inserted index 63 has been sufficiently sized, it can protrude above the panel 51 top edge 64 and can be readily pulled out to quickly locate an address or phone number for the user. In addition, the display panel 51 can also be rotated forward on hinge 54 to read names and addresses written on the back thereof.

It should be clear that the present invention has improved the standard foldable easel type display mount by providing an easel mount doing away with locking tongues and slots and providing greater flexibility by having multiple easel positions and display panel angles. However, the present invention should not be construed as limited to the forms shown which are to be considered illustrative rather than restrictive.

I claim:

1. An easel-type display mount comprising:

a first display panel having front and rear faces and having a plurality of edges;

a second display panel having front and rear faces and having a plurality of edges;

said first display panel and second display panel being attached together with said first display panel having a hinge line along one edge thereon for rotation thereof relative to said second display panel;

a base panel having a plurality of edges, said base panel having said second display panel attached thereto in a face to face relationship and covering a portion of said base panel; and a support panel having a plurality of edges and being hingedly attached to one edge of said base panel with a ductile hinge for moving said support panel relative to said base panel and relative to said first display panel for supporting said first display panel with said support panel to thereby form a supporting easel for said first display panel in different angular positions by the angle said support panel is held with said ductile hinge whereby an easel display mount provides a plurality of display positions.

2. An easel-type display mount in accordance with claim 1 in which said base panel is attached to said support panel with an aluminum ductile hinge.

3. An easel-type display mount in accordance with claim 2 in which said second display panel and said base panel are formed from one panel.

4. An easel-type display mount in accordance with claim 2 in which said first display panel is case bound thereover and has a calendar pad attached thereto.

5. An easel-type display mount in accordance with claim 4 in which said first display panel has a transparent polymer band attached thereacross and has said calendar pad attached therewith.

6. An easel-type display mount comprising:

a first display panel having front and rear faces and having a plurality of edges;

a second display panel having front and rear faces and having a plurality of edges and having a smaller surface area than said first display panel;

one edge of said first display panel being attached to one edge of said second display panel with a ductile aluminum hinge for rotation of said first display panel on said second display panel and positioning said first display panel relative to said second display panel; and a base panel having a plurality of edges and having at least twice the surface area of said second display panel, said base panel having said second display panel attached thereto in a face to face relationship to cover a portion of said base panel to thereby position said ductile aluminum hinge between said first and second display panels between a pair of edges of said base panel.

7. An easel-type display mount in accordance with claim 6 including a support panel having a plurality of edges and being hingedly attached to one edge of said base panel with a ductile hinge for moving said support panel relative to said base panel and relative to said first display panel for supporting said first display panel with a support panel to thereby form a supporting easel for said first display panel in different angular positions by the angle said support panel is held with said ductile hinge whereby an easel display mount provides a plurality of display positions.

8. An easel-type display mount in accordance with claim 7 in which said base panel is attached to said support panel with an aluminum ductile hinge.

9. An easel-type display mount in accordance with claim 8 in which said first display panel is case bound thereover and has a calendar pad attached thereto.

* * * * *